US005647248A

United States Patent [19]

Silsby, Jr.

[11] Patent Number: 5,647,248

[45] Date of Patent: Jul. 15, 1997

[54] DOOR HANDLE PROTECTIVE DEVICE

[76] Inventor: Winfield F. Silsby, Jr., 472 Pringle St., Pringle, Pa. 18714

[21] Appl. No.: 611,768

[22] Filed: Jun. 5, 1996

[51] Int. Cl.[6] ..... G05G 1/06

[52] U.S. Cl. ..... 74/558.5; 150/155; 292/DIG. 2

[58] Field of Search ..... 74/558, 558.5; 150/155; 16/DIG. 12; 70/DIG. 58; 292/DIG. 2, 347; 49/460

[56] References Cited

U.S. PATENT DOCUMENTS

| | | | |
|---|---|---|---|
| D. 169,698 | 5/1953 | Rogers | 70/DIG. 58 X |
| 585,657 | 7/1897 | Dickson | 16/DIG. 12 X |
| 1,244,404 | 10/1917 | Ankovitz . | |
| 2,578,547 | 12/1951 | Hilger | 70/DIG. 58 X |
| 3,222,951 | 12/1965 | Maursey | 74/558.5 X |
| 3,556,571 | 1/1971 | Laub, Jr. | 70/DIG. 58 X |
| 3,960,396 | 6/1976 | Miyahraa | 292/347 |
| 4,811,637 | 3/1989 | McCleary | 81/177.2 |
| 4,862,642 | 9/1989 | Alessi | 49/460 |

*Primary Examiner*—Charles A. Marmor
*Assistant Examiner*—Mary Ann Battista
*Attorney, Agent, or Firm*—Anthony J. Dixon, Esq.

[57] ABSTRACT

A stretchable door handle cover device constructed preferably of synthetic rubber material which resists stretching having a main body wider than the handle to be protected with an upper tab which is inserted beneath the handle base thereby fixing the device to the door handle and a lower receptacle defined in the cover into which a cup accommodatingly larger than the end of the door handle is inserted so that the body of the cover can be stretched over the handle and held in place by engaging the cup over the end of the door handle.

3 Claims, 2 Drawing Sheets

DOOR HANDLE PROTECTIVE DEVICE

BACKGROUND OF THE INVENTION

1. Field of the Invention

The present invention relates to the field of door handle covers. More particularly, it relates to the field of protective covers to be used on lever type handles mounted on a fixed base.

2. Background and Prior Art

In the field of door handles and exterior or outside uses, the problem of protection from the elements has long been a problem. In the area of pad locks and hasp type locks, this problem has been approached by use of a single flap type cover which often blows about in the wind and is still subject to the elements in large degree. Handles such as exterior truck handles usually do not allow for a flapping piece of material to be affixed to them with the safety problem attached to such devices. Also, the force of the wind passing over a moving vehicle makes this type of cover less than effective.

Other types of handles, such as disclosed by Miyahara in U.S. Pat. No. 3,960,396, issued Jun. 1, 1976, are more directed at handle use than protection. The same limitation exists in U.S. Pat. No. 4,811,637, issued to McCleary, Mar. 14, 1989. U.S. Pat. No. 4,862,642, issued to Alessi Sep. 5, 1989, discloses a type of cover which is primarily decorative and does not seem to allow for any protection. Older padlock type covers which do not address the problems being solved by the present invention are exemplified by U.S. Pat. No. 1,244,404, issued to Ankovitz, Oct. 23, 1917.

None of these references cited nor the art in general deals with the ongoing problem of protection of an exterior lever type handle from the elements.

Accordingly, it is a primary object of this invention to provide a stretchable, clear handle cover which attaches to the base of a lever type handle and when engaged, completely protects it from the elements.

It is a further object of the present invention to provide an easily engaged cover which is usable in the vast majority of lever type door handles now in use without the need to modify the handle structures.

These and other objects of the invention will become more readily apparent and evident from the description set forth herein when considered in conjunction with the accompanying drawings.

SUMMARY

The present invention provides a handle cover of stretchable, elastic material of a size wider than the door handle to be protected and, when stretched, at least as long as the lever so that the resistance in the material holds the device in place. The main body has a tab defined in one end which protrudes from the raised body and can be inserted under the upper edge of the handle base. The lower end of the main body defines a receptacle into which a cup of aluminum, high impact plastic or other suitable resistant material is inserted. The cup is accommodatingly larger than the end of the lever. When in position, the body is stretched over the outside of the lever and the cup is engaged over the end of the lever and held there by the elasticity of the body. In this way, the entire base, lever and door handle assembly is quickly and conveniently covered. To open the door, the cup is grasped and pulled downward to free the lever for normal door operation.

DESCRIPTION OF THE INVENTION AND THE PREFERRED EMBODIMENT

Figure 1:
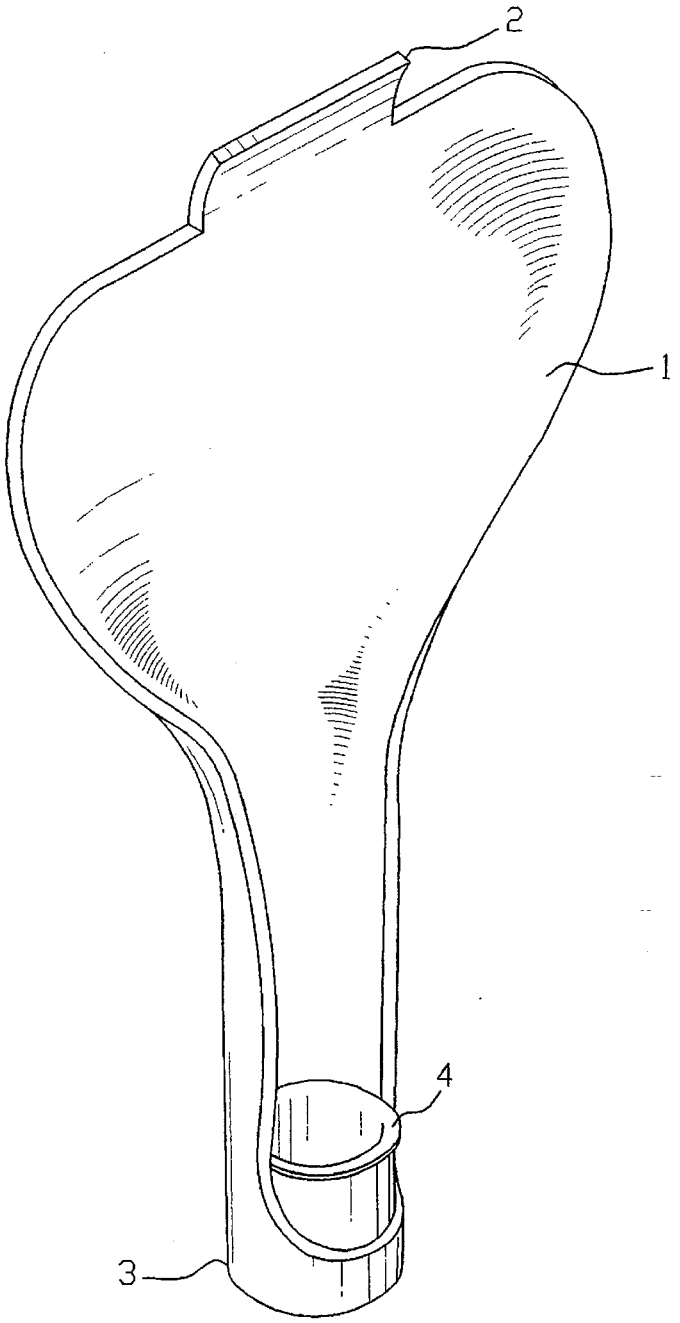
FIG. 1 is a perspective view of the present invention.
Figure 2:
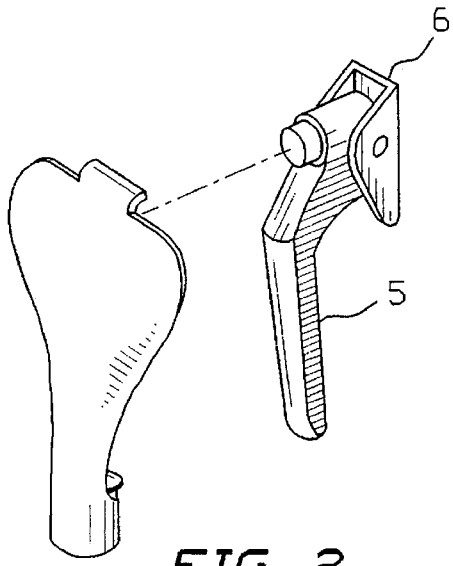
FIG. 2 is a perspective view of the invention and the typical door handle to be covered.
Figure 3:
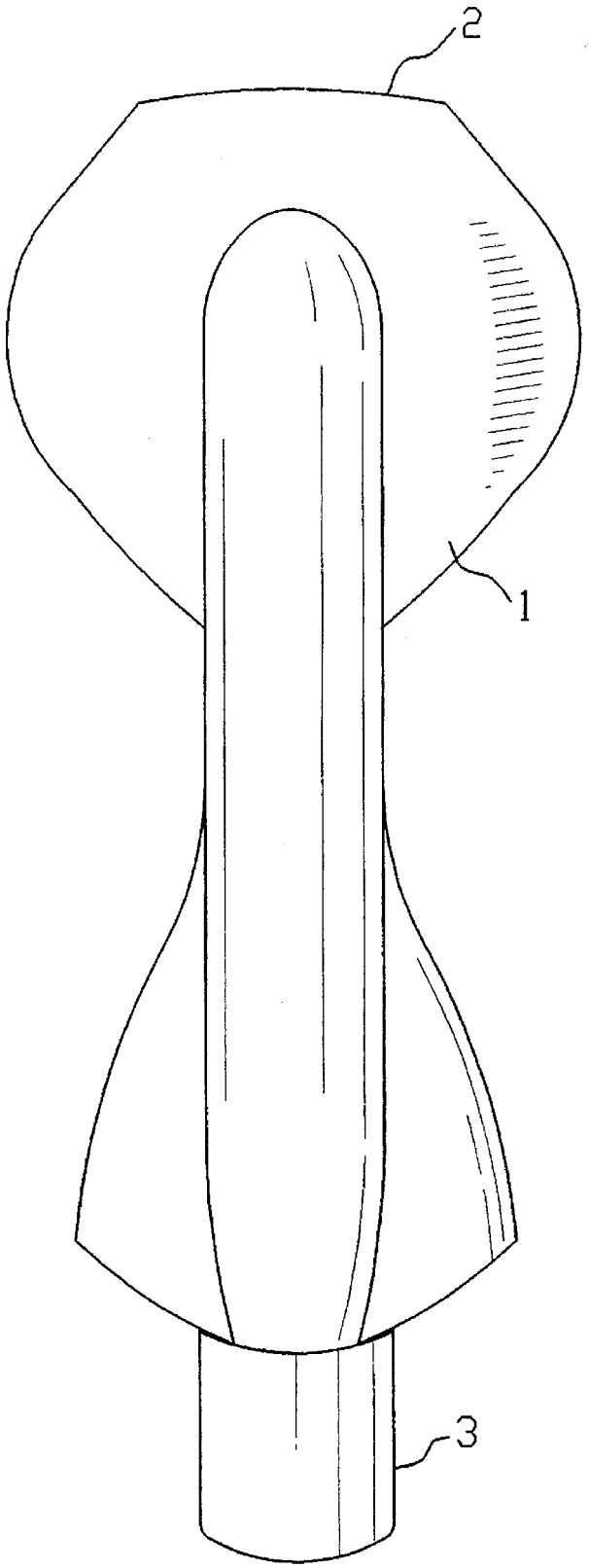
FIG. 3 shows the device installed and engaged.

With reference to the drawings, a detailed description of the invention and its use is as follows. The main body of the device, 1, is constructed of a synthetic rubber material or other material which resists weather and seals to resume its unstretched dimension when stretched. At one end is tab, 2, which protrudes from the main body and is of a thickness to be inserted under the base, 6, of handle, 5. When this is done, the device is in a position to be engaged and disengaged at will. At the other end of the main body, the material of the body is formed to create a receptacle, 3, into which a cup, 4, is inserted. The cup can be of aluminum, high impact resistant plastic or other material which can withstand the rigors of use in the field.

By pulling downwardly, the body is stretched and the cup is engaged over the end of handle, 5. The elasticity of the material holds it in place and also holds it firmly, skin-like, over the entire door handle.

To disengage the device, the process is reversed. The cup end is grasped, pulled downwardly and disengaged by lifting the device, the entire handle, buttons, if any, and lock, if any, is accessible.

This engagement over the handle protects it from all exterior hazards such as snow, ice, water, stones, bumps, road salt, sun, wind, freeze-up and similar hazards familiar to anyone who used a handle outside in inclement weather. Further use of this type of cover will greatly reduce the need for maintenance and cleaning of expensive handle hardware.

While this preferred embodiment of the invention has been shown and described, it will be apparent to those skilled in the art that various modifications may be made without departing from the spirit and scope of the present invention. For that reason, the scope of the invention is set forth in the following claims.

I claim:

1. A handle cover covering an exterior door handle with a base and a lever comprising:

a. a main stretchable body wider than the door handle and stretchable to a length longer than the lever;

b. an insert tab defined on an upper end of the body and protruding therefrom;

c. a receptacle defined in a lower end of the body; and d. a cup accommodatingly larger than an end of the lever and inserted into the receptacle wherein the tab is inserted under the base of the door handle in a fixed position; the body is stretched to a length longer than the lever; the cup is engaged over the end of the lever and held by the elasticity of the body; and the body covers the door handle lever.

2. The handle cover of claim 1 wherein the main stretchable body is comprised of synthetic rubber and the cup is comprised of aluminum.

3. The handle cover of claim 1 wherein the main stretchable body is comprised of synthetic rubber and the cup is composed of impact resistant plastic.

* * * * *